US009708767B2

(12) United States Patent
Goerrel

(10) Patent No.: US 9,708,767 B2
(45) Date of Patent: Jul. 18, 2017

(54) EXTENDED NIP ROLL FOR USE IN A NIP THROUGH WHICH A FIBROUS WEB IS TO BE PASSED

(71) Applicant: Valmet Aktiebolag, Sundsvall (SE)

(72) Inventor: Mats Goerrel, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 0 days.

(21) Appl. No.: 14/917,696

(22) PCT Filed: Oct. 29, 2014

(86) PCT No.: PCT/SE2014/051276

§ 371 (c)(1),
(2) Date: Mar. 9, 2016

(87) PCT Pub. No.: WO2015/072907

PCT Pub. Date: May 21, 2015

(65) Prior Publication Data

US 2016/0215452 A1 Jul. 28, 2016

(30) Foreign Application Priority Data

Nov. 14, 2013 (SE) ..... 1351346

(51) Int. Cl.
*D21F 3/06* (2006.01)
*D21F 3/02* (2006.01)
*D21G 1/00* (2006.01)

(52) U.S. Cl.
CPC ..... *D21F 3/0209* (2013.01); *D21F 3/0218* (2013.01); *D21G 1/006* (2013.01)

(58) Field of Classification Search
CPC ..... D21F 3/06; D21F 3/0209; D21F 3/0218; D21G 1/0206

(Continued)

(56) References Cited

U.S. PATENT DOCUMENTS 5,011,578 A 4/1991 Lange et al.
5,084,137 A 1/1992 Ilmarinen et al.
(Continued)

FOREIGN PATENT DOCUMENTS

CN 1115832 A 1/1996
CN 1133076 A 10/1996
(Continued)

OTHER PUBLICATIONS

State Intellectual Property Office of the P.R.C., First Office Action, including Search Report, for Application No. 201480060381.0, Nov. 28, 2016, 12 pages, China.
(Continued)

*Primary Examiner* — Mark Halpern
(74) *Attorney, Agent, or Firm* — Alston & Bird LLP

(57) ABSTRACT

The invention relates to an extended nip roll 1 for use in a nip N through which a fibrous web W is to be passed. The roll has two axial ends 3, 4 and comprises a support beam 5 having an axial extension between the axial ends 3, 4 of the extended nip roll and a press body 6 with an axial extension and which press body 6 is substantially parallel with the support beam 5 as well as means 7 supported by the support beam 5 for causing the press body to move or expand radially outwards towards a counter roll 2 to form a nip N. The inventive roll also comprises a tubular flexible jacket 8 with two axial ends 12, 13, the tubular flexible jacket 8 forming a loop around the press body 6 and the support beam 5. At each end of the extended nip roll 1, there is an end wall 9, 10 which is rotatably journalled to allow each end wall 9, 10 to rotate about the support beam 5. Each end wall 9, 10 being attached to an axial end 12, 13 of the tubular flexible jacket 8 such that the end walls 9, 10 and the tubular flexible jacket 8 form together an enclosed space 14. On the support beam 5, there is at least one support element
(Continued)

15 for the tubular flexible jacket 8 which support element 15 is arranged to support a part of the tubular flexible jacket 8 at a location spaced away from the press body 6. According to the invention, the at least one support element 15 is arranged to be movable in a circumferential direction such that it can be moved to different positions along the circumference of the tubular flexible jacket 8.

8 Claims, 9 Drawing Sheets

(58) Field of Classification Search
USPC ..... 162/361
See application file for complete search history.

(56) References Cited

U.S. PATENT DOCUMENTS

| | | | |
|---|---|---|---|
| 5,111,563 | A | 5/1992 | Brown et al. |
| 5,520,782 | A | 5/1996 | Schiel |
| 5,662,777 | A | 9/1997 | Schiel et al. |
| 5,882,483 | A | 3/1999 | Mulligan |
| 5,900,118 | A | 5/1999 | Breiten |
| 5,904,813 | A | 5/1999 | Bengtsson et al. |
| 5,925,219 | A | 7/1999 | Schiel |
| 6,010,443 | A | 1/2000 | Dahlbom et al. |
| 6,017,422 | A | 1/2000 | Brox |
| 6,036,820 | A | 3/2000 | Schiel et al. |
| 6,158,335 | A | 12/2000 | Safman et al. |
| 6,383,338 | B1 | 5/2002 | Meschenmoser |
| 6,702,928 | B2 | 3/2004 | Aho |
| 7,387,710 | B2 | 6/2008 | Bengtsson |
| 7,527,708 | B2 | 5/2009 | Gustavsson |
| 7,666,277 | B2 | 2/2010 | Brendel et al. |

FOREIGN PATENT DOCUMENTS

| | | | |
|---|---|---|---|
| EP | 1316643 | A2 | 6/2003 |
| FI | 104274 | B | 12/1999 |
| WO | WO 95/10659 | A1 | 4/1995 |
| WO | WO 00/70143 | A1 | 11/2000 |
| WO | WO 01/44570 | A1 | 6/2001 |
| WO | WO 2013/014025 | A1 | 1/2013 |

OTHER PUBLICATIONS

Aratron AB, "Linear Bearings", retrieved from <http://www.aratron.se/sv/vara-produkter/linjara-lagringar> on Feb. 29, 2016, 2 pages.

International Searching Authority, International Search Report and Written Opinion for International Application No. PCT/SE2014/051276, Feb. 10, 2015, 11 pages, Swedish Patent and Registration Office, Sweden.

EXTENDED NIP ROLL FOR USE IN A NIP THROUGH WHICH A FIBROUS WEB IS TO BE PASSED

CROSS REFERENCE TO RELATED APPLICATIONS

This application is a National Stage Application, filed under 35 U.S.C. 371, of International Application No. PCT/SE2014/051276, filed Oct. 29, 2014, which claims priority to Swedish Application No. 1351346-0, filed Nov. 14, 2013, the contents of both of which are hereby incorporated by reference in their entirety.

BACKGROUND

Related Field

The present invention relates to an extended nip roll for use in a nip through which a fibrous web is to be passed.

Description of Related Art

It is previously known that an extended nip for treatment and/or processing of a fibrous web can be formed between an extended nip roll and a counter element and where the counter element is normally (but not necessarily) a counter roll. Extended nip rolls have been disclosed in several patents, for example in U.S. Pat. No. 7,527,708, U.S. Pat. No. 6,383,338, U.S. Pat. No. 6,017,422, U.S. Pat. No. 6,010,443, U.S. Pat. No. 6,036,820 and U.S. Pat. No. 5,925,219. Such extended nip devices are typically used for dewatering of wet paper webs in a paper machine but may also be used for other purposes than dewatering. For example, it is known that such devices may also be used for calendering and an example of this is disclosed in U.S. Pat. No. 6,158,335. Extended nip rolls may also be used for other treatment or processing of paper webs, for example in coating devices. In extended nip rolls, a press body is used which is often in the form of a rigid metal shoe (e.g. a shoe of steel or aluminum) and which has a surface which is concave and intended to cooperate with a convex counter element such as a roll to form a nip. Extended nip rolls using such a rigid and concave shoe are usually referred to as "shoe rolls". Instead of a concave metal shoe, an extended nip roll may also use a press body which is flexible and capable of adapting its shape to the shape of a counter element. An example of such a device is disclosed in for example U.S. Pat. No. 7,527,708.

In extended nip rolls with a press body, the press body is looped by a tubular flexible jacket and the axial ends of the tubular flexible jacket are usually attached to end walls such that an enclosed space is created. It is desirable that, during operation, the tubular flexible jacket does not sag or flatter. To prevent the tubular flexible jacket from sagging or fluttering, the enclosed space can be filled with pressurized air. Feeding pressurized air to the inside of the tubular flexible jacket helps the jacket to keep its shape. To provide further support for the flexible tubular jacket, the extended nip roll may be provided with an internal support ledge that is arranged to support the flexible tubular jacket. U.S. Pat. No. 5,520,782 discloses embodiments where the jacket of a shoe press may be supported by radially movable support ledges 31, 38 (see for example FIG. 5 or FIG. 6 of U.S. Pat. No. 5,520,782). A support element such as a support ledge may be helpful in making the jacket keep its shape. The object of the present invention is to provide an improved supporting device for the tubular jacket of an extended nip roll.

BRIEF SUMMARY

The inventive extended nip roll is a roll for use in a nip through which a fibrous web is to be passed. The inventive extended nip roll has two axial ends and comprises a support beam having an axial extension between the axial ends of the extended nip roll and a press body having an axial extension. The press body is substantially parallel with the support beam. The inventive extended nip roll further comprises means supported by the support beam for causing the press body to move or expand radially outwards towards a counter roll to form a nip. Furthermore, the inventive extended nip roll comprises a tubular flexible jacket with two axial ends. The tubular flexible jacket forms a loop around the press body and the support beam. At each axial end of the extended nip roll, an end wall is rotatably journalled to allow each end wall to rotate about the support beam and each of the end walls is attached to an axial end of the tubular flexible jacket such that the end walls and the tubular flexible jacket form together an enclosed space. On the support beam there is at least one support element for the tubular flexible jacket which support element is arranged to support a part of the tubular flexible jacket at a location spaced away from the press body. The at least one support element is arranged to be movable in a circumferential direction such that it can be moved to different positions along the circumference of the tubular flexible jacket.

In embodiments of the invention, the extended nip roll comprises at least one curved guide which is carried by the support beam and which extends over at least a part of the circumference of the extended nip roll. The curved guide is located inside the tubular flexible jacket. In such embodiments, the extended nip roll may also comprise a carriage which is movable on the curved guide and on which carriage the at least one support element is carried. At least one first actuator may be carried on the support beam and arranged to act on the carriage and cause the carriage to move along the curved guide such that the circumferential position of the support element can be changed.

Preferably, the at least one support element is arranged to be movable also in a radial direction but embodiments are conceivable in which the at least one support element is movable only in the circumferential direction.

In embodiments having a carriage that is movable on a curved guide, a console may optionally be mounted on the carriage such that it travels together with the carriage. The at least one support element may then be mounted on a bracket that is carried by the carriage and arranged to be linearly movable in relation to the console along a bearing guide such that the bracket and the support element which is mounted on the bracket can slide in relation to the console and move in a direction radially outwards or radially inwards. At least one second actuator may then be arranged to act either directly on the support element or on the bracket carrying the at least one support element such that the at least one support element moves in the radial direction.

The bearing guide may optionally comprise a linear bearing and a rail. However, other bearing guides are conceivable, for example a bearing guide using a slide bearing.

The carriage may comprise an element shaped as a circular segment.

In advantageous embodiments, the extended nip roll has two or more support elements for the tubular flexible jacket.

In embodiments using at least one second actuator for radial displacement of the support element, the second actuator is preferably carried on the carriage and travels together with the carriage.

Preferably, the extended nip roll comprises at least two curved guides and wherein each curved guide has a carriage and one and the same support element is carried by a carriage on each curved guide.

DETAILED DESCRIPTION OF VARIOUS EMBODIMENTS

Figure 1:
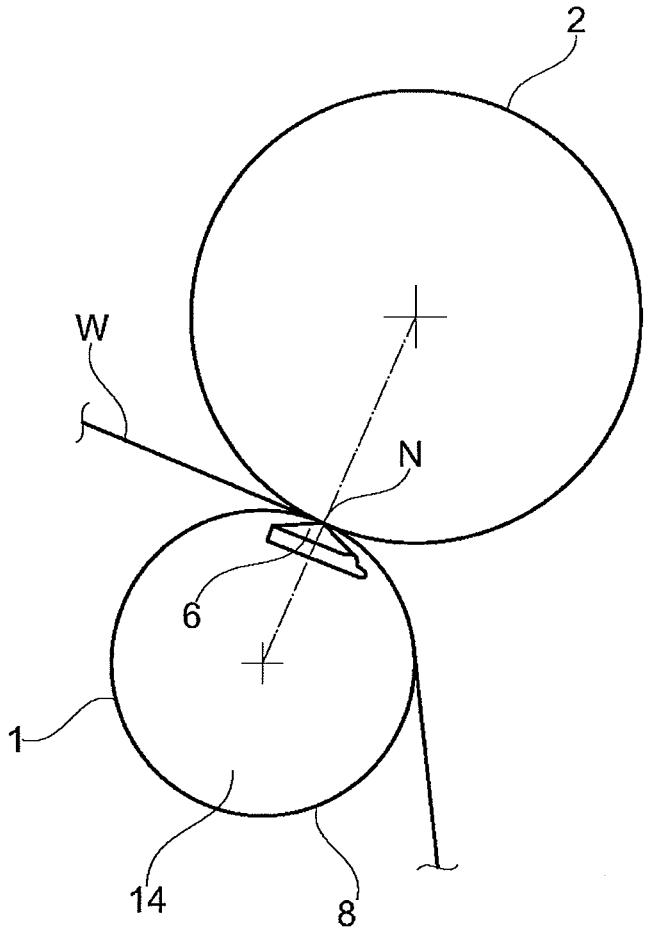
FIG. 1 is a side view of a press nip formed between an extended nip roll and a counter roll
Figure 2:
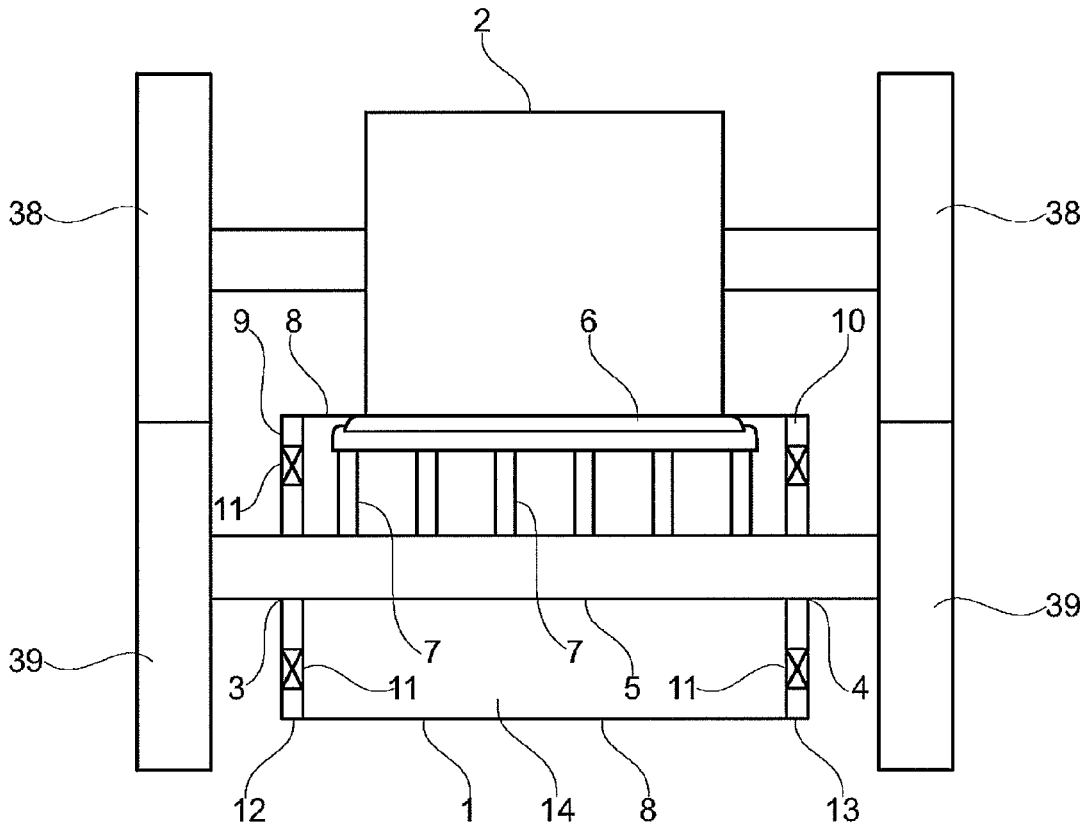
FIG. 2 is a diagrammatic longitudinal sectional view of an extended nip roll that forms a nip with a counter roll.

With reference to FIG. 1, the invention relates to an extended nip roll 1 which is intended to be used in a nip N through which a fibrous web W is to be passed. The nip N is formed between the extended nip roll 1 and a counter roll 2. The counter roll 2 is rotatable and may be mounted in first bearing housings 38. As can be seen in FIG. 2, the extended nip roll has two axial ends 3, 4 and the extended nip roll 1 comprises a support beam 5 that has an axial extension between the axial ends 3, 4 of the extended nip roll 1. The support beam 5 may be mounted in second bearing housings 39 that may optionally be connected to the first bearing housings 38. The support beam 5 of the extended nip roll is normally not rotatable. The extended nip roll 1 further comprises a press body 6 that also has an axial extension (i.e. it extends in the axial direction of the extended nip roll 2) and the press body 6 is substantially parallel with the support beam 5. The press body 6 may be a rigid metal shoe with a concave surface facing the counter roll 2 but is could also be an elastically deformable body. The extended nip roll 1 is also provided with means 7 for causing the press body 6 to move or expand radially outwards towards the counter roll 2 to form a nip N. The means 7 for causing the press body to move or expand radially outwardly are supported (directly or indirectly) by the support beam 5. In FIG. 2, the means 7 for causing the press body 6 to move or expand radially outwards have been schematically indicated as hydraulic jacks. Extended nip rolls that use hydraulic jacks to cause a press body to move outwards are known from many patents, for example from U.S. Pat. No. 5,084,137, U.S. Pat. No. 5,662,777 and U.S. Pat. No. 7,387,710 and the present invention may be used also for extended nip rolls using such hydraulic elements to act on the press body. It has also been suggested that, instead of one or several rows of hydraulic jacks, the press body could be acted upon by a single piston and such a solution is known from, for example, U.S. Pat. No. 5,882,483 and the extended nip roll according to the present invention may use also such means to cause radial movement of the press body. Another solution for causing the press body to move or expand radially outwards is disclosed in, for example, U.S. Pat. No. 7,527,708. According to U.S. Pat. No. 7,527,708, the extended nip roll may have a press body which is elastically deformable and has one or several internal cavities that can be filled with a pressurized fluid such that the press body expands radially outwards. The pressurized fluid may be supplied from an external source but the cavity or cavities that are filled with pressurized fluid are located inside the press body itself. In such a device, the means for causing the press body to move or expand radially outwards are thus at least partially integral with the press body itself. The present invention can advantageously be used in connection with such extended nip devices that are disclosed in U.S. Pat. No. 7,527,708. It should be understood that, for the present invention, the press body 6 and the entire arrangement for supporting the press body 6 and causing it to expand radially outwards against a counter element such as a counter roll may be identically the same as the one disclosed in U.S. Pat. No. 7,527,708.

In FIG. 2, it can be seen how the extended nip roll 1 further comprises a tubular flexible jacket 8 with to axial ends 12, 13. The tubular flexible jacket 8 may be made of polyurethane or a material that comprises polyurethane or has similar properties. The tubular flexible jacket 8 forms a loop around the press body 6 and the support beam 5. At each axial end 3, 4 of the extended nip roll 1, there is an end wall 9, 10 which is rotatably journalled to allow each end wall 9, 10 to rotate about the support beam 5. Bearings 11 allow the end walls 9, 10 to rotate. The arrangement of the bearings 11 may take many different embodiments and one possible embodiment is disclosed in U.S. Pat. No. 5,084,137. Each end wall 9, 10 is attached to an axial end 12, 13 of the tubular flexible jacket 8 such that the end walls 9, 10 and the tubular flexible jacket 8 form together an enclosed space 14. The ends 12, 13 of the tubular flexible jacket 8 may be attached to the end walls 9, 10 in many different ways and possible solutions are disclosed in the prior art, for example in U.S. Pat. No. 6,702,928, U.S. Pat. No. 5,904,813, U.S. Pat. No. 5,011,578 and in WO 2013/014025 and any solution for attaching the ends of the flexible tubular jacket 8 to the end walls 9, 10 may be used for the present invention. For example, the ends 12, 13 of the tubular flexible jacket 8 may be attached to the end walls 9, 10 in one of the ways disclosed in the above indicated patents but other attachment solutions can also be used.

With reference to FIG. 1, a technical problem relating to extended nip roll will now be discussed. In order to ensure that the tubular flexible jacket 8 stays in shape, the enclosed space 14 is often connected to a source of pressurized air such that it can be inflated like a balloon. An extended nip roll according to the present invention may also be connected to a source of pressurized air or gas such that the enclosed space 14 can be filled with pressurized air or gas. However, such a precaution may sometimes be insufficient or require pressures so high that they are undesirable for other reasons. Therefore, it has been suggested that the extended nip roll 1 be provided with internal supports that support the tubular flexible jacket from within. The inventor has found that when the paper web (possibly together with fabrics such as felts or TAD wires) meets the outer surface of the tubular flexible jacket 8, this may cause the jacket 8 to sag in the area where it meets the web. In FIG. 1, the web W is showed as being on contact with the tubular flexible jacket along almost 25% of the circumference of the tubular flexible jacket and this is an area where sagging of the jacket may occur. If it is known in advance where the web W will contact the tubular flexible jacket 8, an internal support can be placed in that area. However, if a standardized extended nip roll is to be sold to many different buyers, the operating conditions may vary from one user to another. Furthermore, the operating conditions for a particular user may change over time such that the risk of sagging is moved from one part of the tubular flexible jacket to another. The present invention has a solution to this problem.

Figure 5:
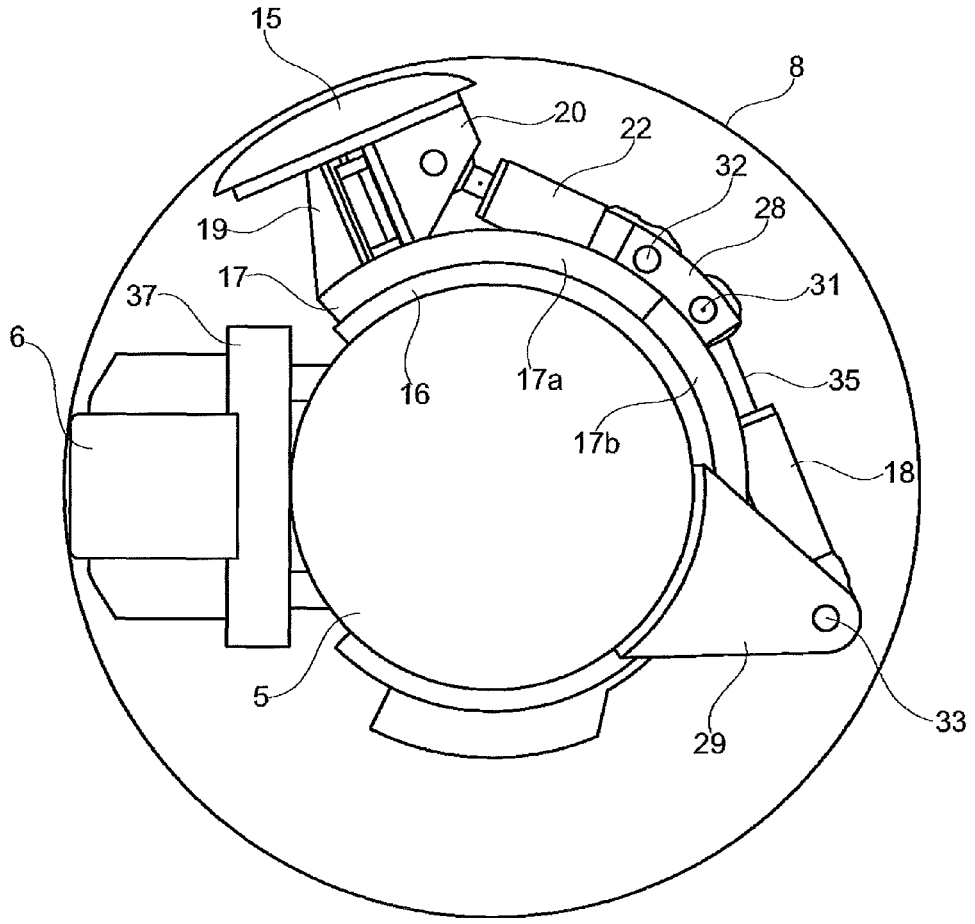
FIG. 5 is a side view showing the support element in an inner radial position

With reference to FIG. 5, the press body 6 may be an elastically deformable press body which is supported in a holder 37 which is carried on the support beam 5.

With reference to FIG. 3-FIG. 6, the inventive extended nip roll 1 additionally comprises, on the support beam 5, at least one support element 15 for the tubular flexible jacket 8. The support element 15 is arranged to support a part of the tubular flexible jacket 8 at a location spaced away from the press body 6 (i.e. at a distance from the press body in the circumferential direction). According to the invention, the at least one support element 15 is arranged to be movable in a circumferential direction such that it can be moved to different positions along the circumference of the tubular flexible jacket 8.

Figure 3:
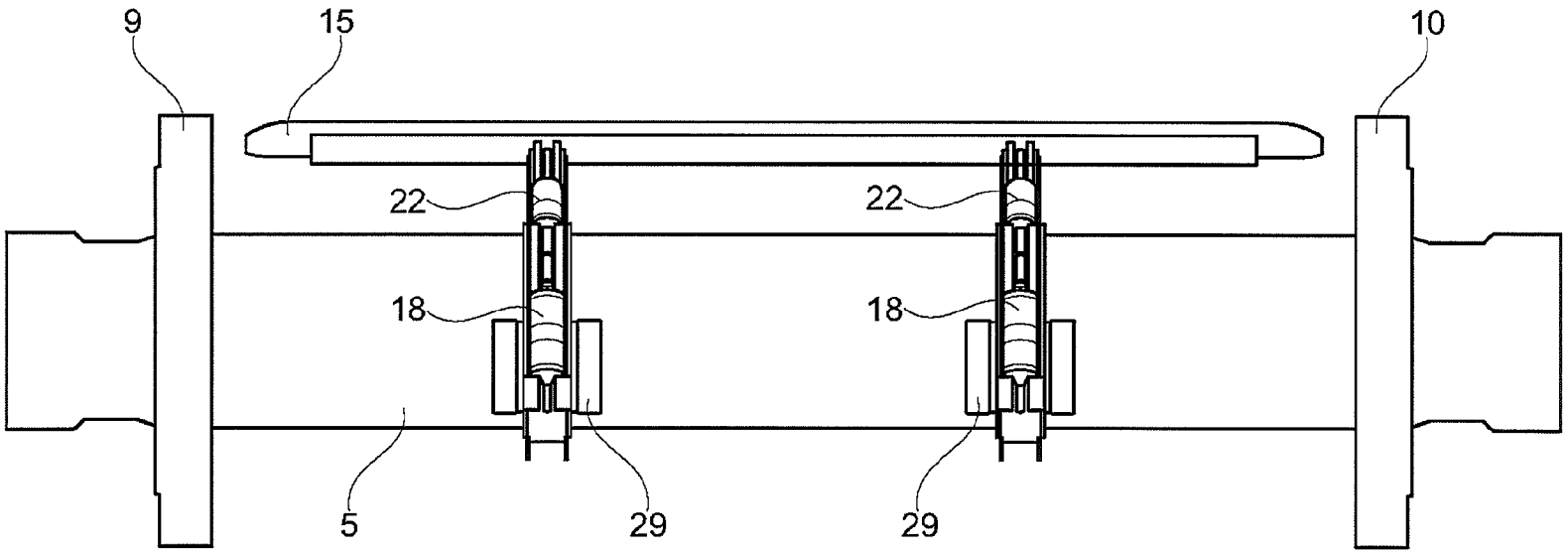
FIG. 3 shows a longitudinal view of a support beam for an extended nip roll on which support beam a support element for the tubular flexible jacket has been mounted.
Figure 4:
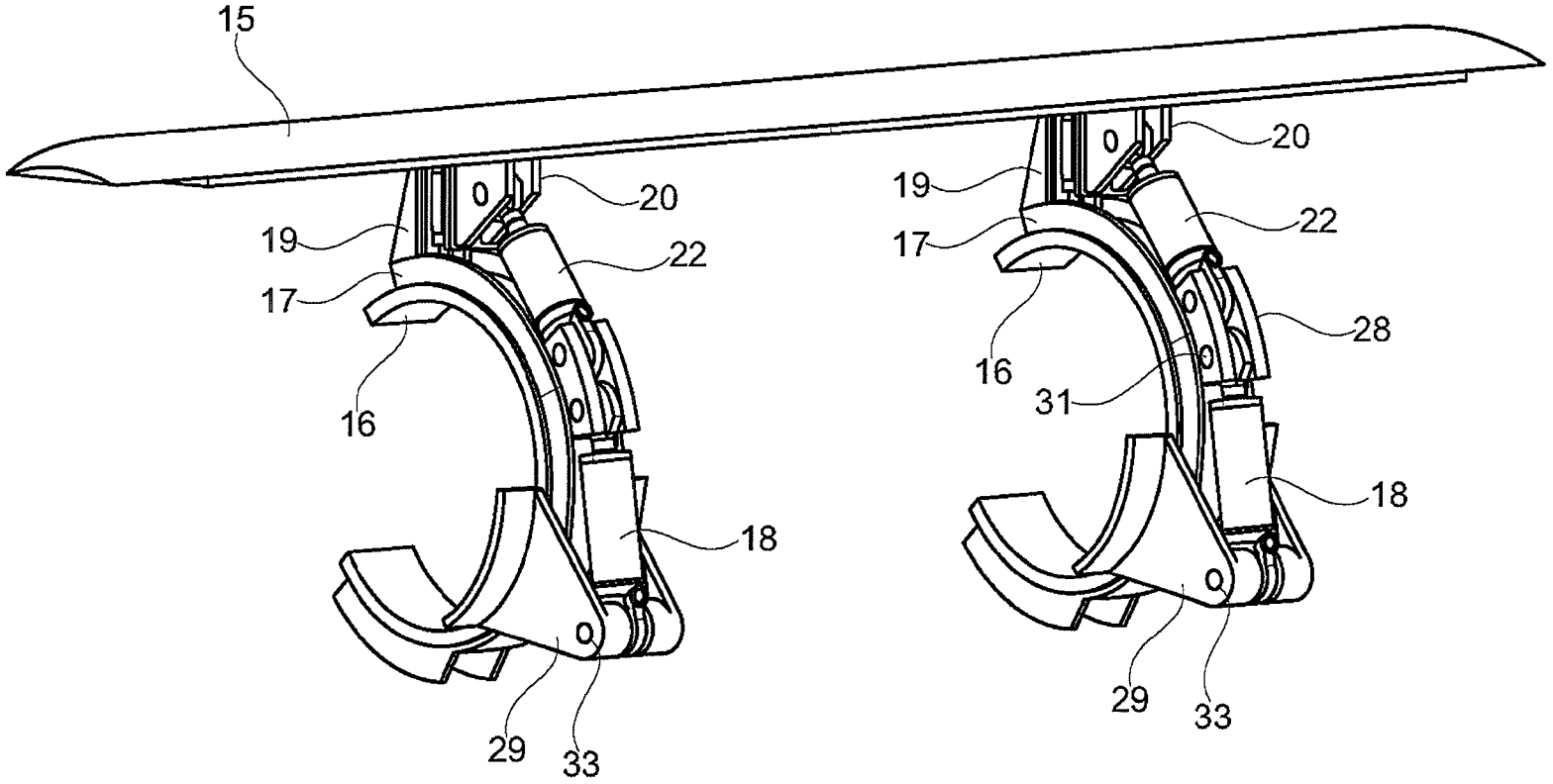
FIG. 4 is a perspective view showing the support element and how it is mounted on curved guides.

Reference will now be made to FIG. 4 and FIG. 5. Different arrangements can be used to ensure that the support element 15 can be moved in the circumferential direction (i.e. along the inner circumference of the tubular flexible jacket 8). In an advantageous embodiment, the extended nip roll 1 comprises at least one curved guide 16 which is carried by the support beam 5 and which extends over at least a part of the circumference of the extended nip roll 1. The curved guide 16 is located inside the tubular flexible jacket 8 and a carriage 17 is movable on the curved guide 16. On the carriage 17, the at least one support element 15 is carried. With reference to FIG. 3, FIG. 4 and FIG. 5, the curved guide can be fixed on the support beam 5 by such known means as for example, welding, screws or bolts. Embodiments are also conceivable in which the beam 5 and the curved guide are made in one piece by casting. How the curved guide 16 is fixed to the support beam 5 is not of decisive importance for the invention. The curved guide 16 thus remains stationary in relation to the support beam 5. Embodiments are also conceivable in which the curved guide 16 is detachably secured to the support beam 5 such that it can be moved between different axial and circumferential positions and secured to the support beam 5 in different axial and/or circumferential positions.

Figure 6:
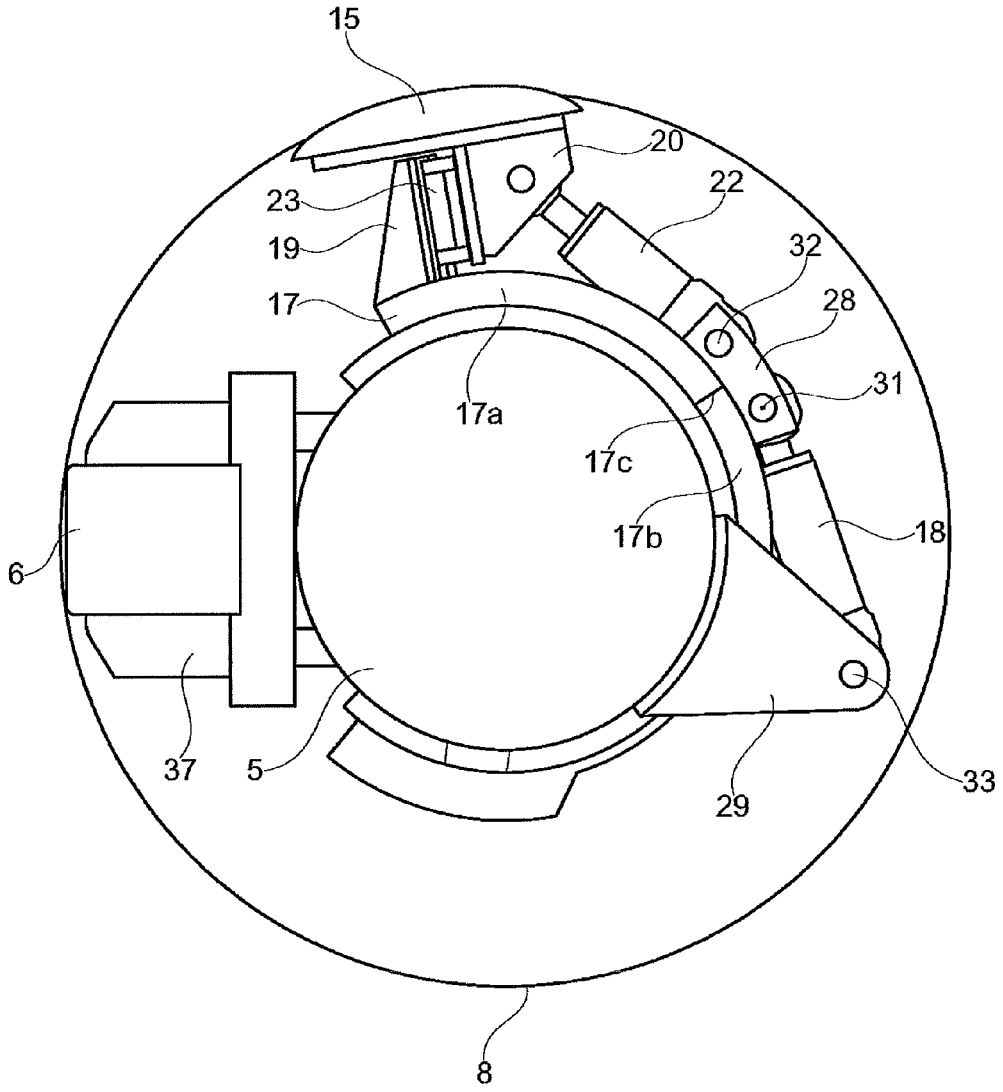
FIG. 6 is a side view showing the support element in an outer radial position
Figure 7:
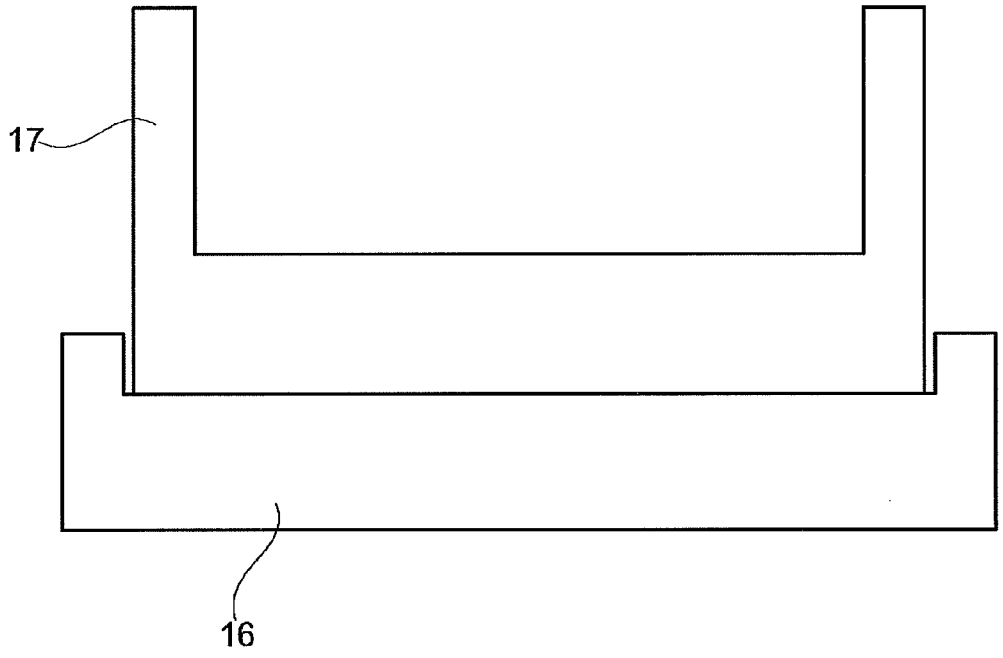
FIG. 7 is a cross-sectional view of a curved guide and a carriage.

As can be seen in FIG. 3, FIG. 5 and FIG. 6, a bracket 29 is fixedly connected to the support beam 5 and straddles the curved guide 16. In this way, the bracket 29 can support an actuator which can act on the carriage 17. The bracket 29 may be fixed to the support beam 5 by suitable means such as for example screws, nuts and bolts, welding or other suitable methods. The bracket 29 is thus fixed in its position in relation to the support beam 5 but embodiments are conceivable in which the bracket 29 is removably secured to the support beam 5. Embodiments are conceivable in which the curved guide 16 is not secured directly on the support beam 5 but on the bracket 29. However, the stability in such a solution would probably be inferior. The carriage 17 may also be curved and placed on the curved guide 16. The carriage 17 may be seen as a circular segment and can be made of two or more segments 17*a*, 17*b* that are connected to each other at 17*c* and the connection can be achieved by any known method such as screws bolts, rivets, welding etc. In FIG. 7, a cross-section of the curved guide and the carriage 17 is showed. It should be understood that the curved guide 16 may be described as an inner ring segment while the carriage 17 can be described as an outer ring segment (in this context, the terms "inner" and "outer" refer to what is an inner or an outer radial position in relation to the support beam 5). The carriage 17 can be a circular segment made of copper or an alloy such as bronze that comprises copper while the curved guide 16 may be of steel. A copper alloy such as bronze can glide on steel. Optionally, the curved guide 16 and/or the carriage may have a coating that reduces friction or a lubricant may be applied between the carriage 17 and the curved guide 16.

As can be seen in FIG. 4, FIG. 5 and FIG. 6, there is at least one first actuator 18 which is carried on the support beam 5. In FIG. 3-FIG. 6, it can be seen how first actuator or actuators 18 is/are carried by the bracket(s) 29 that are connected to the support beam and the at least one first actuator is thereby carried on the support beam 5. The at least one first actuator 18 is preferably arranged such that it can turn about an axis and thereby change the direction in which it acts. In FIG. 4 and FIG. 5, an embodiment is showed in which a pivot link 33 connects the bracket or brackets 29 to the lower end of the first actuator(s) 18 such that the at least one first actuator can pivot and thereby change the direction in which it acts. In advantageous embodiments, there are at least two such first actuators 18 (see FIG. 3 and FIG. 4) and the at least one first actuator 18 may be, for example, a hydraulic piston-and-cylinder device but other solutions are also possible, for example pneumatic actuators. The at least one first actuator 18 is arranged to act on the carriage 17 and cause the carriage 17 to move along the curved guide 16 such that the circumferential position of the support element 15 can be changed. The at least one first actuator can be arranged to act directly or indirectly on the carriage 17 such that the carriage 17 is caused to glide along the curved guide 16. The support element 15 is mounted either directly on the carriage 17 or on an element such as a bracket 20 that is mounted on the carriage 17. When the at least one first actuator 18 is activated, the carriage 17 moves along the curved guide 16 and the at least one support element 15 which is directly or indirectly mounted on the carriage 17 will follow the movement of the carriage. Thereby, the circumferential position of the at least one support element 15 can be changed from one circumferential position to another.

In preferred embodiments, the at least one support element 15 is arranged to be movable also in a radial direction. With reference to FIG. 5, FIG. 6, FIG. 8 and FIG. 9, the radial movement of the support element will now be explained. A console 19 may be mounted on the carriage 17 such that it travels together with the carriage 17. The at least one support element 15 is mounted on a bracket 20 that is carried by the carriage 17. The bracket 20 may be arranged to be linearly movable in relation to the console 19 along a bearing guide 21 such that the bracket 20 and the support element 15 which is mounted on the bracket 20 can slide in relation to the console 19 and move in a direction radially outwards or radially inwards. At least one second actuator 22 is arranged to act either directly on the support element 15 or on the bracket 20 carrying the at least one support element 15 such that the at least one support element 15 moves in the radial direction. The at least one second actuator may be any kind of actuator, for example a hydraulic or pneumatic cylinder. In the embodiment shown in FIG. 6, the bracket 20 is carried by the carriage 17 through the second actuator 22 that also travels together with the carriage 17.

Figure 8:
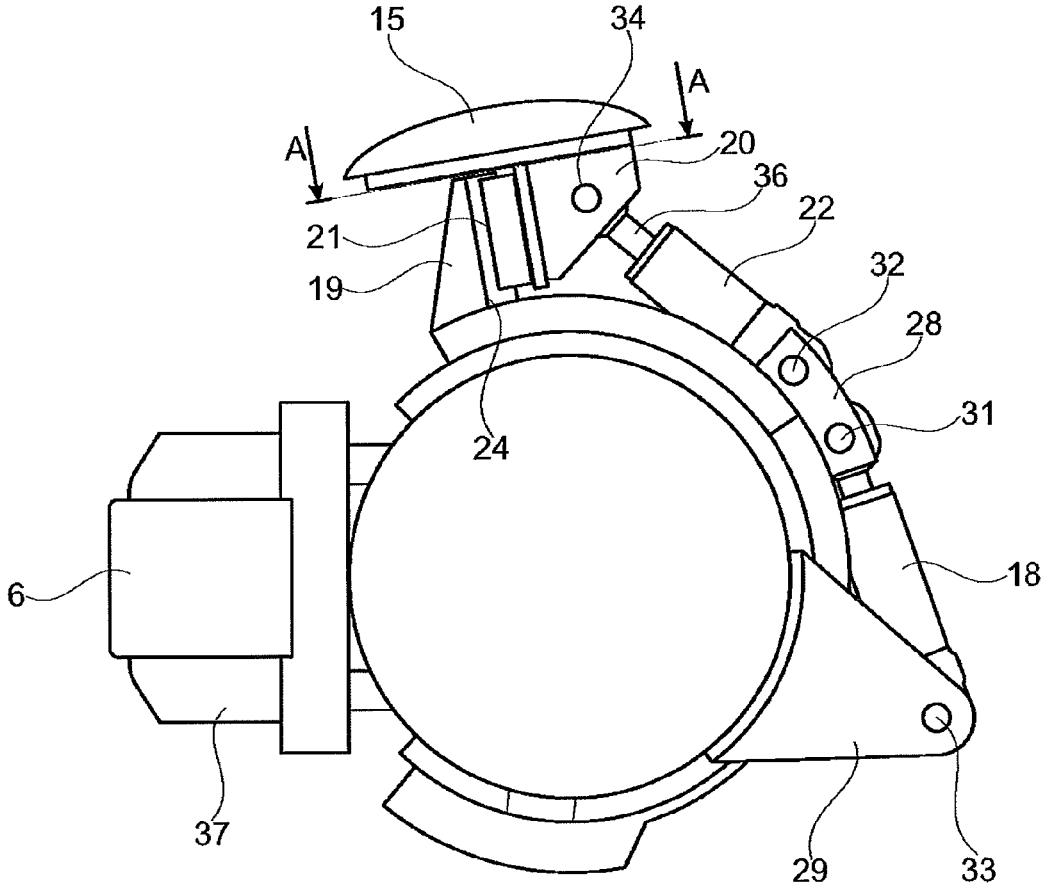
FIG. 8 is a cross-sectional view similar to FIG. 5 and FIG. 6 but without a tubular flexible belt
Figure 9:
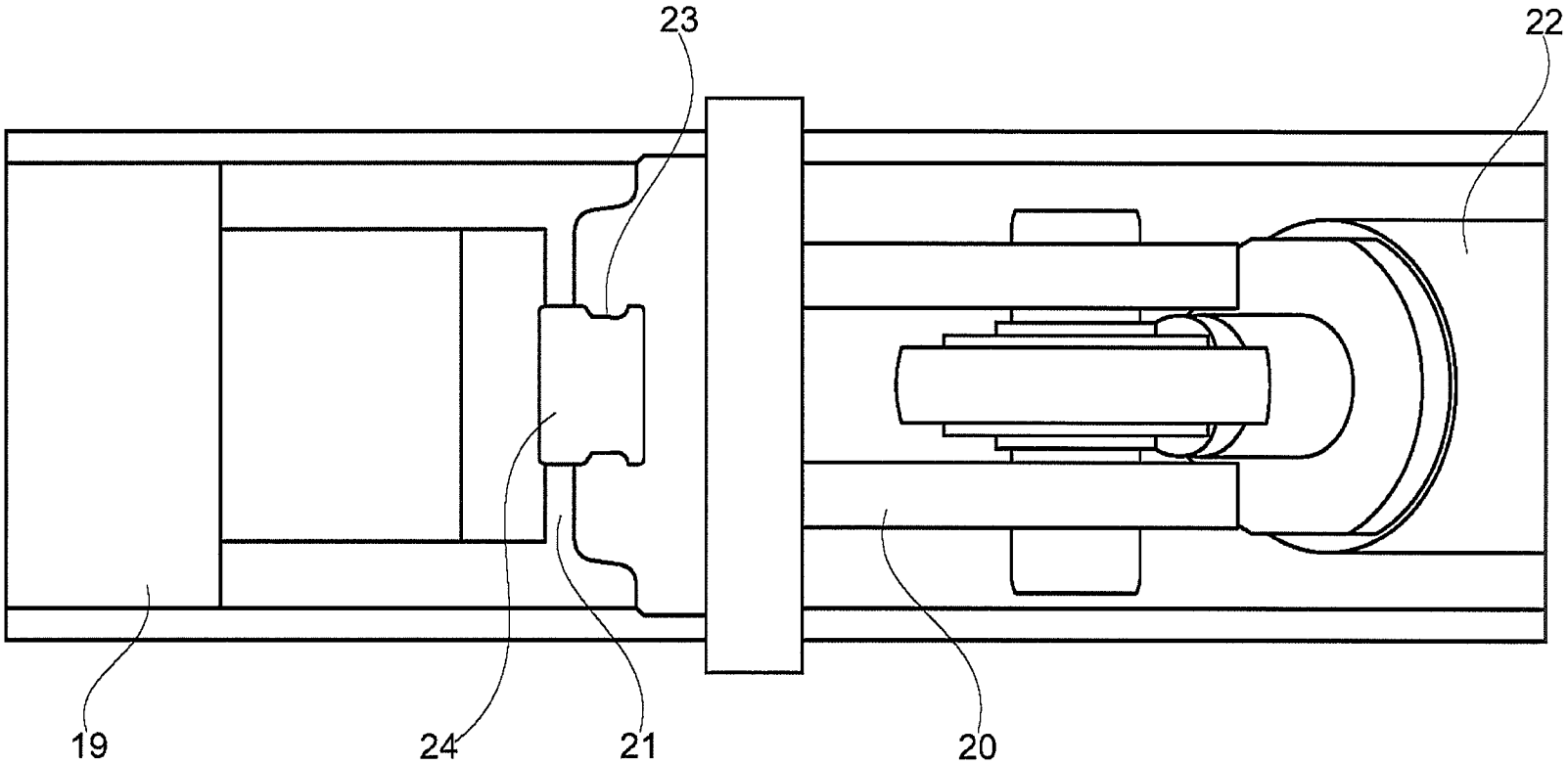
FIG. 9 is a sectional view along lines A-A in FIG. 8.

A possible embodiment of the bearing guide 21 will now be explained with reference to FIG. 9 which is a sectional view from above along lines A-A in FIG. 8. The bearing guide 21 may comprise a linear bearing 23 and a rail 24. In the embodiment according to FIG. 9, the rail is mounted on the console 19 or is an integral projecting part of the console 19 while the linear bearing is mounted on the bracket 20 on which the at least one support element 15 is mounted. A suitable linear bearing can be obtained from, for example, Aratron AB, Smidesvägen 4-8, SE 171 41 SOLNA, Sweden.

In preferred embodiments, the extended nip roll 1 comprises at least two curved guides 16 and each curved guide 16 may have a carriage 17. In such embodiments, one and the same support element 15 is carried by a carriage 17 on each curved guide 16. In the same way, the extended nip roll may have to first actuators 18, one for each curved guide. Also, the extended nip roll 1 may have a second actuator 22 for each curved guide 16. It should be understood that there may be more than two curved guides 16 with a corresponding carriage and actuators 18, 22.

The second actuator 22 is mounted on the carriage 17 and follows the carriage 17 in its circumferential movement. When the second actuator(s) 22 is (are) activated, the second actuator 22 will act on the bracket(s) 20 that carries (carry) the at least one support element 15. This will cause the bracket(s) 20 to glide along the bearing guide in a direction which is radially outwards such that the at least one support element 15 moves radially outwards.

FIG. 5 shows the support element 15 in a radially inner position in which it has not contacted the tubular flexible jacket 8. FIG. 6 shows the support element in a radially outer position in which the second actuator(s) 22 has (have) acted on the bracket 20 such that the bracket 20 has moved along the bearing guide 21 and moved the support element outwards to contact and support the tubular flexible jacket 8.

The circumferential movement of the support element 15 can also be understood by a look at FIG. 5 and FIG. 6. In FIG. 6, the support element 15 is in a first circumferential position and the first actuator 18 has not yet been activated. When the first actuator (s) 18 is (are) activated, the carriage 17 will be caused to move along the curved guide 16 and reach the position that can be seen in FIG. 5. In FIG. 5, it can be seen how a piston 35 has extended from the first actuator 18 which may be a hydraulic cylinder with a piston 35.

In the figures, only one support element 15 has been showed but it should be understood that embodiments are possible in which the extended nip roll 1 has two or more support elements 15 for the tubular flexible jacket 8.

As explained above, the at least one second actuator 22 is carried on the carriage 17 and travels together with the carriage 17. In for example FIG. 5, it can be seen how the first actuator and second actuator 22 may be coupled to each other via a linkage 28. A pivot link 31 may connect the piston 35 of the first actuator 18 to the linkage 28 and another pivot link 32 may connect the lower end of the second actuator 22 to the linkage 28. The linkage 28 may be fixedly connected to the carriage 17 such that the first actuator 18 acts on the carriage 17 via the linkage 28 (this can also be described in terms of the linkage being a part of the carriage 17). A pivot link 34 may connect the piston 36 of the second actuator 22 to the bracket 20 that carries the support element 15.

The invention can be used in extended nip rolls used for wet pressing, calendering or coating. Another possible area where extended nip rolls according to the present invention may be used is for lamination where a paper web is laminated with a plastic film in a nip formed between an extended nip roll and a counter roll. It should also be understood that the inventive extended nip roll may be used in any other process in which a web is passed through a nip formed between an extended nip roll and a counter roll. Thanks to the invention, the extended nip roll can have support for the flexible jacket which can be adjusted to the circumstances and different degrees of wrap of the paper web around the circumference of the tubular flexible belt.

In embodiments using both a first and a second actuator, the advantage is obtained that radial position of the support element and circumferential position of the support element can be adjusted independently of each other. The curved guide with the carriage that is movable on the curved guide entails the advantage that the circumferential position of the support element can be adjusted easily. In embodiments using two or more first actuators, i.e. actuators for changing/adjusting the position of the support element in the circumferential direction, the first actuators should preferably be arranged to act in a coordinated way such that they move their respective carriages to the same extent in order to avoid that the support element becomes slanted. In the same way, when more than one second actuator are used, i.e. actuators for adjusting radial position of the support element, they should be arranged to act in a coordinated way to move the support element to the same extent.

By making the support element movable also in the radial direction, the support element can meet changing conditions. For example, if the wrap angle of the web around the circumference of the tubular flexible jacket changes or if tension in fabrics changes, this may require more or less adjustment in the radial direction.

By having a console 19 and a bracket 20 that cooperate for adjustment in the radial direction and making these elements movable together with the carriage 17, radial adjustment can be achieved at the right place even after displacement in the circumferential direction. It is to be noted that the second actuator or second actuators 22 can also travel with the carriage 17 to allow adjustment in the radial direction at the right circumferential position.

The use of a linear bearing 23 and a rail 24 for adjustment in the radial position is a practical solution that enables a precise adjustment in the radial direction.

In embodiments using two or more curved guides, the advantage is obtained that the support element itself can be better supported and therefore more stable.

The invention claimed is:

1. An extended nip roll (1) for use in a nip (N) through which a fibrous web (W) is to be passed, the extended nip roll (1) having two axial ends (3, 4) and comprising:

a support beam (5) having an axial extension between the axial ends (3, 4) of the extended nip roll (1);

a press body (6) having an axial extension and which press body (6) is substantially parallel with the support beam (5);

means (7) supported by the support beam (5) for causing the press body to move or expand radially outwards towards a counter roll (2) to form a nip (N);

a tubular flexible jacket (8) with two axial ends (12, 13), the tubular flexible jacket (8) forming a loop around the press body (6) and the support beam (5);

at each axial end (3, 4) of the extended nip roll (1), an end wall (9, 10) which is rotatably journaled to allow each end wall (9, 10) to rotate about the support beam (5), each end wall (9, 10) being attached to an axial end (12, 13) of the tubular flexible jacket (8) such that the end walls (9, 10) and the tubular flexible jacket (8) form together an enclosed space (14);

and on the support beam (5), at least one support element (15) for the tubular flexible jacket (8) which support element (15) is arranged to support a part of the tubular flexible jacket (8) at a location spaced away from the press body (6), wherein the at least one support element (15) is arranged to be movable in a circumferential direction such that it can be moved to different positions along the circumference of the tubular flexible jacket (8); and the extended nip further comprises:

at least one curved guide (16) which is carried by the support beam (5) and which extends over at least a part of the circumference of the extended nip roll (1), the curved guide (16) being located inside the tubular flexible jacket (8);

a carriage (17) which is movable on the curved guide (16) and on which carriage (17) the at least one support element (15) is carried;

and at least one first actuator (18) which is carried on the support beam (5) and arranged to act on the carriage (17) and cause the carriage (17) to move along the curved guide (16) such that the circumferential position of the support element (15) can be changed.

2. An extended nip roll (1) according to claim 1, wherein the at least one support element (15) is arranged to be movable also in a radial direction.

3. An extended nip roll (1) according to claim 2, wherein:

a console (19) is mounted on the carriage (17) such that it travels together with the carriage (17);

the at least one support element (15) is mounted on a bracket (20) that is carried by the carriage (17) and arranged to be linearly movable in relation to the console (19) along a bearing guide (21) such that the bracket (20) and the support element (15) which is mounted on the bracket (20) can slide in relation to the console (19) and move in a direction radially outwards or radially inwards; and at least one second actuator (22) is arranged to act either directly on the support element (15) or on the bracket (20) carrying the at least one support element (15) such that the at least one support element (15) moves in the radial direction.

4. An extended nip roll (1) according to claim 3, wherein the bearing guide (21) comprises a linear bearing (23) and a rail (24).

5. An extended nip roll (1) according to claim 3, wherein the carriage (17) comprises an element shaped as a circular segment.

6. An extended nip roll (1) according to claim 3, wherein the at least one second actuator (22) is carried on the carriage (17) and travels together with the carriage (17).

7. An extended nip roll (1) according to claim 1, wherein the extended nip roll (1) has two or more support elements for the tubular flexible jacket.

8. An extended nip roll (1) according to claim 1, wherein:

the extended nip roll (1) comprises at least two curved guides (16); and each curved guide (16) has a carriage (17) and one and the same support element (15) is carried by a carriage (17) on each curved guide (16).

* * * * *